United States Patent [19]

Kuhne et al.

[11] 4,044,665

[45] Aug. 30, 1977

[54] PRINTING MACHINES

[75] Inventors: Kurt Anton Kuhne, Manawatu; Alexander Wassilieff, Palmerston North, both of New Zealand

[73] Assignee: Delta Plastics Limited, Palmerston North, New Zealand

[21] Appl. No.: 666,058

[22] Filed: Mar. 11, 1976

[30] Foreign Application Priority Data

Mar. 12, 1975 New Zealand ..... 176915

[51] Int. Cl.[2] ..... B41J 1/60

[52] U.S. Cl. ..... 101/21; 101/27; 101/109

[58] Field of Search ..... 101/9–11, 101/18, 21, 27, 29, 31, 42, 45, 47, 78, 84, 57, 62, 109; 353/103; 274/11 F

[56] References Cited

U.S. PATENT DOCUMENTS

| | | | |
|---|---|---|---|
| 2,646,748 | 7/1953 | Brown | 101/109 |
| 2,777,385 | 1/1957 | Bachy | 101/42 |
| 3,589,279 | 6/1971 | Deutsch | 101/27 |
| 3,626,845 | 12/1971 | Whitaker | 101/109 X |
| 3,774,529 | 11/1973 | Filsinger et al. | 101/27 |

*Primary Examiner*—Edward M. Coven

[57] ABSTRACT

A magazine type printing head for a printing machine having at least one two part chamber with a stack of typeface carrying slugs in each part. The head has means which move an upper slug from a stack in one part of the chamber to the second part and then moves a lower slug in the second part to a printing position in the first part of the chamber. The printing head has particular application in a hot stamping machine where means to heat the slugs are provided. A dye carrying foil is conveyed adjacent the typeface of the slug or slugs in the printing position. A movable support retains an article to be stamped and presses the article together with the foil against the typeface.

15 Claims, 8 Drawing Figures

PRINTING MACHINES

BACKGROUND OF THE INVENTION

This invention relates to a printing head for a printing machine. It is common knowledge that plastics materials can have printed matter, decorations or the like applied thereto by the transfer of dye from a carrier foil by heat and pressure. A basic hot stamping machine able to carry out this process consists of a press with a heated flat plate attached to a ram to which the respective embossed die or typeface is fastened. The article to be printed is placed on a holder with the carrier foil placed between the die and article. Pressure is obtained by interaction between the die and holder.

The greatest problem with this type of printing machine resides in the changing of typeface as this is intricate and time consuming. The problem is compounded when, for example, consecutive numbering is being carried out. To overcome this problem a device has been devised which includes numbering wheels otherwise known as an "odometer". The odometer is heated by an electric cartridge element which is located inside the shaft around which the wheels revolve. The odometer has not been entirely satisfactory as the upper half of the wheels receive more heat if kept stationary for a prolonged period.

In consecutive numbering with three or more digits the units and tens revolve around the heater element at reasonably constant intervals thereby equalising the temperature differences in the wheels, but the hundred or thousands are stationary for a prolonged time and lose their heat by virtue of absorption into the material being printed and general heat loss. As a certain quantity and evenness of heat is required to give a good impression and transfer of dye into a plastic article, an inferior imprint relative to the other (units and tens) numerals results. For quality control this is undesirable and in some cases not acceptable.

One aim of the invention is to provide a magazine type printing head for a printing machine which has the facility of speedy selection of different typeface.

A further aim of the invention is to provide a printing head for a hot stamping machine which gives a constant and uniform level of heat over the typeface being used as well as those stored in the head.

SUMMARY OF THE INVENTION

Broadly in one aspect the invention consists of a magazine type printing head for a printing machine comprising at least one two part chamber, a number of stacked typeface carrying slugs in each part of the chamber, operating means moveable from a rest position to move a slug in one part of the chamber to stack of slugs in the second part, said operating means when returning to said rest position moving a slug in the second part to a printing position in the first part.

In a second aspect the invention consists of a hot stamping machine including a printing head according to the foregoing aspect, means to heat the slugs in both parts of the chamber, means to convey a dye carrying foil adjacent the typeface of the slug in the stamping position and a movable support to retain an article to be stamped and press it, together with the said foil against the typeface of the said slug.

Figure 1:
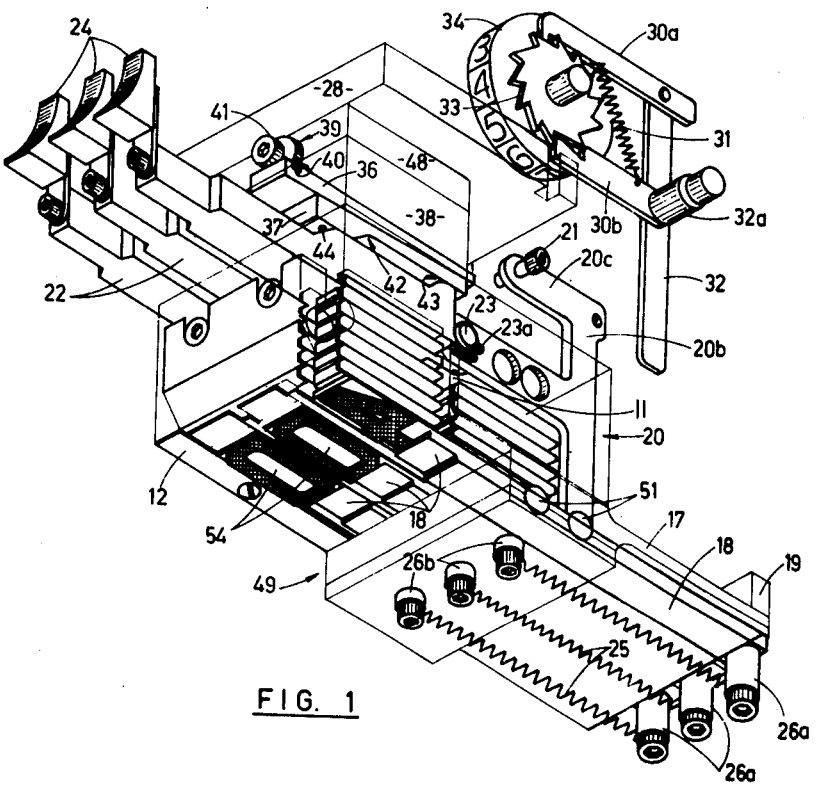
FIG. 1 is a perspective view from the underside of the printing head according to the invention with the external housing removed of more essential parts shown ghosted to show clearly the important component parts of the head.
Figure 3:
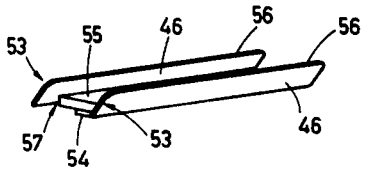
Figures 2A, 2B, 2C, 2D:
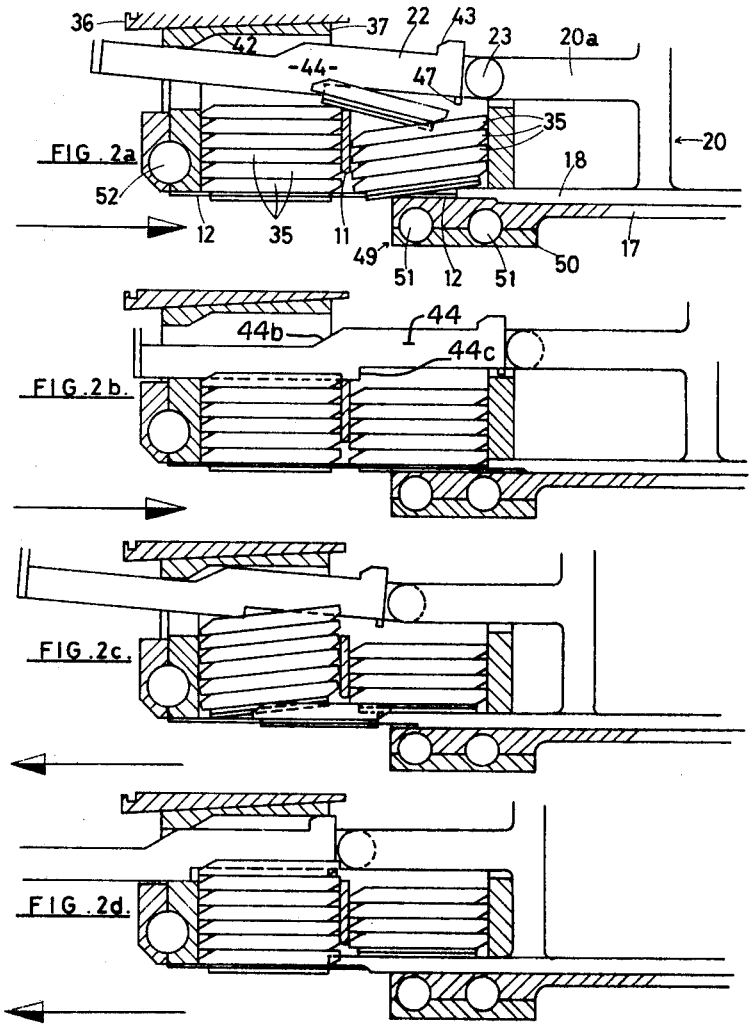
Figure 4:
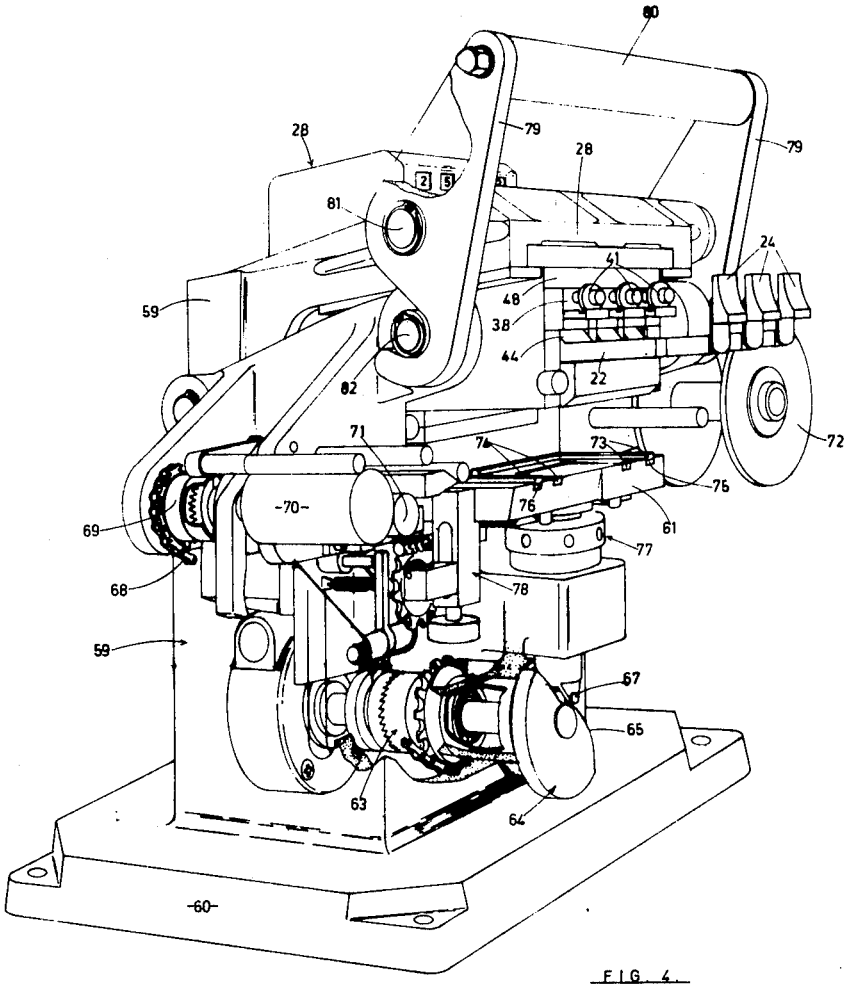
Figure 5:
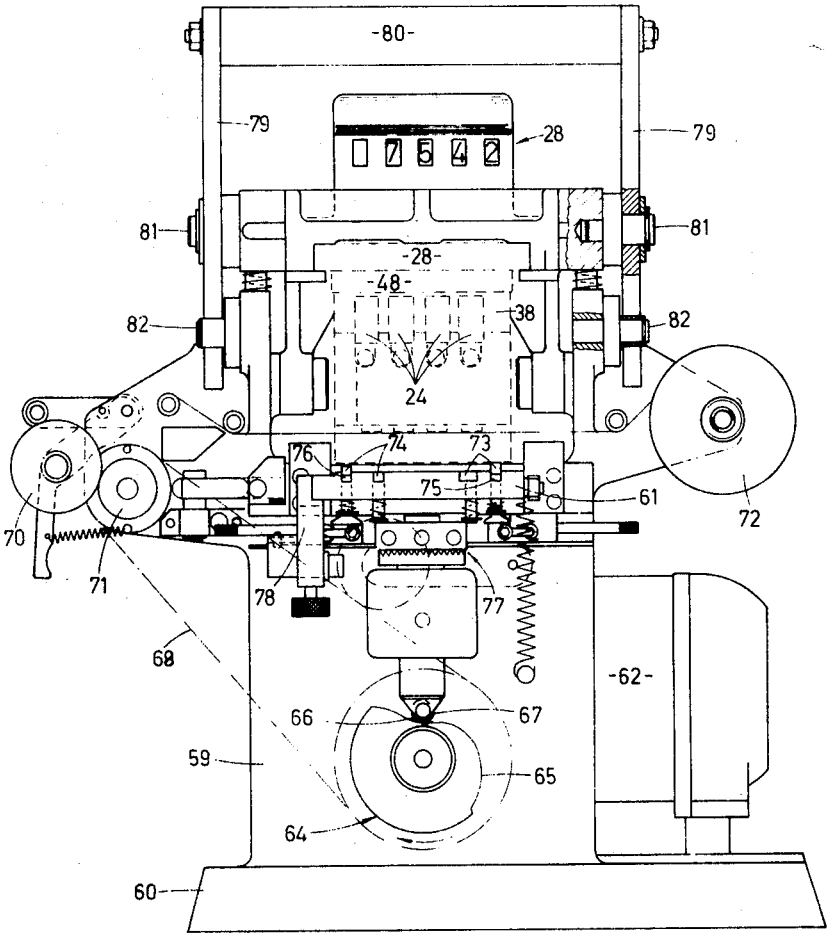

FIGS. *2a–2d* are a series of partial side views showing the slugs and operating means in various positions during the process of replacing one slug by another;

FIG. 3 is a perspective view of one of the slugs;

FIG. 4 is a partially sectioned perspective view of a printing machine with the printing head of FIGS. 1 and 2; and FIG. 5 is a front elevation of the printing machine shown in FIG. 4.

DETAILED DESCRIPTION OF CERTAIN PREFERRED EMBODIMENTS

The printing head shown in FIG. 1 includes three separate chambers and for ease of description the printing head will be described when used in applying numerals to an ear tag of the type described in U.S. Pat. No. 3,731,414. It must be remembered, however, that the printing head is not restricted to any particular number of chambers nor use only in a heat press type of operation nor only for use in applying indica to animal ear tags.

Each chamber is equally divided by a thin separating wall 11 shown ghosted for clarity with integral support rails 12 into two compartments. Two thin strips are attached to the base of the outer side walls of the chamber to act as support rails 12. The separating wall 11 terminates a predetermined distance above the support rails 12. This distance is substantially equal to the thickness of a single slug 35.

Extending rearwardly from the base of the unit is a guide plate 17 which slidably supports a number of fingers 18. A stop 19 is provided on the outer edge of the guide plate 17 which acts as a guide and for lateral arrest of the fingers. Each finger 18 is connected to one end of the cross piece of a substantially T-shaped link 20 the stem 20*a* of which is in turn connected to a pressure bar 22. The stem 20*a* is pivotally connected to pressure bar 22 by a shouldered pivot pin 23 passing loosely through holes in the ends of stem 20*a* and pressure bar 22. A spring clip 23*a* retains the point pin in position. The free end 20*b* of the cross piece of T shaped link 20 is provided with an extension 20*c* parallel to the stem with a hole in which a cylindrical headed screw 21 is located. The link 20 is spring biassed by a tension spring 25 which hooks onto a downwardly depending projection 26*a* on the finger 18 and secured at the other end to a further projection 26*b* spaced from projection 26*a* and attached to the underside of guide plate 17.

The outer end of the pressure bar 22 is provided with a push button 24 whereby an operator may apply a longitudinal pressure to the bar 22. The button 24 is contoured as shown so that the operators pressure is directed in a slightly downward direction. A display unit is mounted on the top plate 28 (see FIGS. 4 and 5) and inside said display unit is housed a display wheel 34 which is rotated by rachet arms 30*a* and 30*b* coupled to operating lever 32. The display wheel includes a toothed gear 33 which is engaged by arms 30*a* and 30*b*. In operation (as will be hereinafter described) the pressure bar 22 moves longitudinally backward and screw 21 engages with the lower end of lever 32 which pivots about pivot point 32*a*. This movement of lever 32 causes arm 30*a* to move toward the front of the printing head and arm 30*b* to move backwardly. Upon return of pressure bar 22 the lever arm 32 pivots back which causes the end of lower arm 30*b* to engage with the toothed gear 33 and so rotate the display wheel 34 by one display digit. Arms 30*a* and 30*b* are maintained in engagement with the toothed gear 33 by spring 31 extending therebetween.

For operation seven slugs 35 are located in the forward compartment and four slugs in the rear compartment. The lowermost slug 35 of the rear compartment rests on finger 18 which abuts against slug 35 of the front compartment. A pair of wedges or gib keys 36 and 37 are located in a slot in the pressure plate 38. The lower wedge 37 is held in place by a lockscrew 39 which passes through a slot in the upper wedge 36. A keyway 40 is formed across the width of the forward end of each upper wedge 36. A flanged adjusting screw 41 fits in a threaded hole in the pressure plate 38 which is immediately above the upper wedge 36 with the flanges locating in the keyway.

The lower wedge 37 is formed with a downwardly depending shoulder 42 across its width at the forward end and this shoulder corresponds to a similar upright shoulder 43 of the same height on the pressure bar 22. A stepped extended guide 44 of the pressure bar 22 protrudes through the front plate 10. The underside of the pressure bar 22 rests on the uppermost slug 35 of the front compartment and is located between the side plates 46 of the slug. A pin 47 on the underside of the pressure bar 22 arrests accidental movement of the slug 35.

The top plate 28 is insulated from the pressure plate 38 by a packer 48 of heat-insulating material. A divided block 49 with an insulating plate 50 is fastened to the base below the rear compartment to carry two electric elements in openings 51. A further opening 52 is provided at the front of the forward compartment to carry a further heating element. These features are not required if the head is to be used for non-heated printing.

Referring now to FIG. 3 each slug 35 has two raised side plates 46 with a tapered and rounded head section 53. The typeface 54 protrudes below the side plates 46 and fits into the space between said side plates so that when slugs are stacked together the typeface of the upper slug fits within the side plates of the lower slug but does not touch the upper surface 55 of the said lower slug. In the stacked situation the slugs rest on the top and bottom ledges 56 and 57 of the side plates 46. The slugs in each chamber, when used for numbering, are 11 in number and include typefaces 0 to 9 and a blank.

The head is simple to operate and any given numeral of a chamber can be selected within three seconds. The slugs 35 are stacked in consecutive order i.e. 4567890 blank 123. To select a given numeral, the pushbutton 24 of pressure bar 22 is pressed until it reaches the end of its travel, (see FIGS. 2*a* and 2*b*). As the pressure bar 22 and selecting finger 18 are connected they both slide backwards. Pressure bar 22 with its shoulder 44*a* pushes the uppermost type slug 35 of the front compartment with it (see FIG. 2*a*) and the slug slides into and is deposited on the uppermost slug of the rear compartment (see FIG. 2*b*). At the same instant selecting finger 18 slides from underneath the lowermost slug 35 of the rear compartment, thereby vacating the space previously occupied by it and allowing the lowermost slug to slide into its place. The slug 35 is now positioned between the lower-most slug of the front compartment and the front end of the selecting finger 18. In this position (see FIG. 2*b*) six slugs are contained in the front compartment and five type slugs in the rear compartment. When pushrod 24 is released, the tension of spring 25 returns the interconnected parts to their operating or "at rest" position. As this happens the selecting finger 18 abutts against the slug 35 of the rear compartment and pushes it under the slug in front of the latter (see FIG. 2*c*), the tapered ends of the side plates slidably cooperating to raise the front slug out of the way of the slug 35, allowing slug 35 to enter the bottom of the front stack (see FIG. 2*d*).

During operation, the pressure bar 22 raises and lowers itself into position. Each pressure bar 22 has an inclined outer face 44*b* and inner shoulder 44*a*, (See FIG. 2) the face 44*b* being provided so that the bar clears the downwardly depending shoulder 42 of lower wedge 37, when the bar 22 slides into the "rest" position, whilst the bar 22 in turn is raised by the uppermost slug 35 pushing against the shoulder 44*a*. When pressure is applied to the lowermost slug of the front compartment the shoulders 42 and 43 limit any upward movement within the bank of slugs of the front compartment. To compensate for wear and adjust the individual banks of slugs to a common base height, the upper wedge 36 can be moved in or out against the lower wedge 37 and the top of the slot in the pressure plate 38 by the adjusting screw 41, thereby altering the overall dimension from the top plate 28 to the typeface of the front compartment 13.

As previously mentioned the printing head according to the present invention can be used in more than one type of printing machine and would have application in either a heat and press or conventional wet-printing process. The head, however, is particularly applicable to the stamping of numerals on animal identification tags.

The printing head is open to modification without departing from the invention. For example the chambers can be in the form of separate units or magazines which can be removed and replaced from the unit by unscrewing the front plate 10. Such magazines would be of great assistance when alphabetical typeface are being used in the unit.

Hereinafter a machine specifically designed for the hot stamping of ear tags will be described. The head according to the foregoing is mounted on a frame 59 attached to base 60 with a hinge action so that it may be pivoted away from a printing table 61. An electric motor 62 and associated reduction gearbox is provided to drive means to raise and lower the printing table 61 and means to move the dye carrier tape.

The motor 62 is coupled via a clutch 63 to a cam 64 which is generally circular with a profile of reduced diameter 65 and a cusp shape 66 provided in its circumference. Coupled to a cam follower 67 is the printing table 61 which is retained to move up and down below the printing head. The motor 62 also drives a chain 68 which couples via a dog clutch 69 with a ridged roller 70. This ridged roller 70 and an associated pressure roller 71 draws dye carrying tape from a spool 72 positioned at the opposite side of the printing table 61. The tape thus passes directly below the printing head.

The table 61 is provided with a series of moveable abutments which form locations for different sized tags. L shaped abutments 73 are provided on the table 61 near the edge adjacent the spool 72. These abutments 73 normally lie in slots 75 within the table but any one can be raised and locked into position to suit the size of tag being printed. Near the other edge of the table 61 moveable abutments 74 are provided but these are straight and adapted to move automatically back into slots 76 the table 61 once the table is moved onto the typeface of the printing head slugs. The reason for this movement will hereinafter become apparent. Means 77 are provided to adjust the height of the table 61 relative to cam follower 67 to which it is coupled.

An adjustable ramp member 78 is coupled to the movement of the table and this operates the dog clutch 69 associated with the tape roller. The ramp 78 moves up with the table and at a certain predetermined position releases the clutch 69 to stop the tape movement. Accordingly, the distance the tape moves between each tag being stamped can be adjusted.

A separate housing (not shown) contains all the electrical components, thermostats, indicator dials and lights etc. and this is coupled through a multipin plug to thermocouples, heating elements in the printing head and motor.

A solenoid is employed to engage and disengage the motor 62 from the cam 64 and chain drive 68. In operation the solenoid is activated which starts the cam 64 revolving. In the rest position the cam follower 67 lies in the cusp shape 65 with the table 61 in its lowered position. The solenoid is preferably operated by twin press buttons which are pressed simultaneously. Upon activation the table 61, with tag in position between the limit bars or abutments 73 and 74, rises pushing the tag and tape into contact with the hot numerals in the printing head. Simultaneously with the table starting to rise the tape is drawn from spool 72 until the ramp 78 on the table disengages the dog clutch 69 to stop the chain 68 driving the tape roller 70. The heat and pressure stamps the tag and transfers the black pigment from the tape to the tag. After a period the table 61 returns to the bottom of its stroke and a microswitch triggered by the cam 64 deactivates the solenoid which thus disengages the motor drive from the camshaft. During the down stroke the dog clutch 69 is once again engaged which allows the tape, with tag attached thereto due to it sticking to the tape, to move toward the rollers 70 and 71. The straight limiting bars or abutments 74 are for this reason automatically retractable to allow the tag to move off the table unhindered.

The machine can now be reloaded for the next tag to be stamped and the numerals in the printing head changed if required. Electrically controlled stepper motors can be employed to automatically operate the pressure bars 22 of the printing head to preset any given number. During the next sequence of events the tape moves during the upward movement taking the tag still attached toward a ramp or the like which parts the tag from the tape.

To ensure even and complete printing the table can be adjusted in height by the adjusting means 77 and the printing head can be tilted to ensure that even pressure over the entire printed numeral is obtained. The printing head can also be adjusted forward or back to allow for different sized tags on the table. Likewise the line of travel of the tape can also be changed. In addition printing heads with different sized numerals can be slid into the hinged portion of the press.

A quick release mechanism is also incorporated with the head to allow it to hinge back from the table should the machine jam or tags become overlapped due to incorrect adjustment of the tape travel. The mechanism is made up with the two arms 79 at either side of the printing head which are connected by handle 80. The arms 79 are pivotally mounted at 81 medially in their length. The low ends of arms 79 are hook shaped and engage about abutments 82 projecting from the frame 59 of the machine.

The printing head according to this invention provides a ready and quick means of changing the typeface especially in numbering operations. Due to the construction of the unit and positioning of the heating elements the numerals are provided with even heat and there is no difference between the numerals printing units and tens as opposed to those printing hundreds and thousands. With the machine described the printing head provides for rapid printing of products such as animal ear tags whether the printing involves single or consecutive numbering.

What is claimed is:

1. A magazine type printing head for a printing machine comprising:

at least one two part chamber;

a first stack of typeface carrying slugs in a first of said parts, one end of said first stack defining a printing position;

a second stack of typeface carrying slugs in the second of said parts, one end of said second stack defining a removal position, the other end of said second stack defining a depositing position;

operating means movable between a rest position and a second position, said operating means including a first means to move a first slug from the end of said stack remote from said printing position to the depositing position of said second stack as said operating means is moved from said rest position to said second position; and cooperating means on said slugs for moving each slug in said first stack away from said printing position, said operating means further including a second means to move a second slug from the removal position of said second stack to the printing position of said first stack when said operating means is moved from said second position to said rest position.

2. A printing head in accordance with claim 1, wherein said cooperating means comprises tapered ends of said side plates whereby the edges of said side plates essentially define a non-rectangular parallelogram with both acute corners of each side plate extending beyond the ends of said typeface carrying area, whereby the slugs of said first stack are moved away from said printing position by the ramp action of a leading end of said second slug when said second means forces said second slug toward said first stack.

3. A printing head in accordance with claim 1 wherein each slug includes an elongate typeface carrying area for holding a protruding typeface and a side plate extending along each long side of said area, said side plates extending perpendicular to the surface of the elongate area which carries the typeface for a distance greater than the distance the typeface protrudes from the surface of the elongate area.

4. A printing head in accordance with claim 2 wherein the operating means comprises a sliding control member linked to said second means, said second means comprising a sliding finger mounted to move slidably in the two part chamber in response to movement of the control member, said finger being biassed to normally extend into the chamber to engage a trailing end of said second slug as said operating means moves from said second position to said rest position.

5. A printing head in accordance with claim 4 wherein the finger is slidably supported by guide means which extend beyond the said second part of the chamber, the control member being disposed above the finger and joined at one end to a link member connected to the said finger, the end of the finger remote from that end in the chamber being coupled by spring means to the guide means, whereby said end of said finger in the chamber is adjacent said trailing end of said second slug in said second stack when said operating means is in said second position, and said finger is adjacent said trailing end of said second slug when said second slug has been moved to said print position and said operating means is in said rest position.

6. A printing head in accordance with claim 5 wherein the control member includes said first means comprising an engaging portion which upon the control member being moved from said rest position to said second position engages with a slug in the first part of the chamber and moves said slug into the second part of the chamber.

7. A printing head in accordance with claim 6 wherein means are provided to ensure the engaging portion engages a slug when the operating means moves from its rest position but permits restricted movement of the control member when said operating means returns to the rest position to allow the slugs in first part of the chamber to move and accept a slug pushed into the said first part by the finger.

8. A printing head in accordance with claim 7 wherein slug heating means are provided adjacent the second part of the chamber.

9. A printing head as claimed in claim 7 wherein slug heating means are provided adjacent the first part of the chamber.

10. A printing head as claimed in claim 7 wherein slug heating means are provided adjacent each of the first and second parts of the chamber.

11. A printing head as claimed in claim 10 further a display wheel having indica thereon which corresponds to each typeface on the slugs, an operating lever which engages with the said link member upon movement of the controlling means, said operating lever being coupled to two spaced apart ratchet arms each of which engage at diametrically opposed positions with a toothed gear coupled to the display wheel.

12. A printing head as claimed in claim 11 wherein seven slugs are located in the first part of the chamber and four slugs in the second part when the controlling means is in the rest position.

13. A hot stamping machine including a printing head comprising:

at least one two part chamber;

a first stack of typeface carrying slugs in a first of said parts, one end of said first stack being a printing position;

a second stack of typeface carrying slugs in the second of said parts, one end of said second stack being a removal position, the other end of said second stack being a depositing position;

operating means movable between a rest position and a second position, said operating means including a first means to move a first slug from the end of said stack remote from said printing position to the depositing position of said second stack as said operating means is moved from said rest position to said second position; and cooperating means on said slugs for moving each slug in said first stack away from said printing position, said operating means further including a second means to move a second slug from the removal position of said second stack to the printing position of said first stack when said operating means is moved from said second position to said rest position, said machine further including means to heat the slugs in both parts of the chamber, means to convey a dye carrying foil adjacent the typeface of the slug in the printing position and a movable support to retain an article to be stamped and press it, together with the said foil against the typeface of the said slug.

14. A hot stamping machine in accordance with claim 13 wherein the printing head is mounted on a frame which is supported on a base, there being provided a prime mover to drive the means to convey the dye carrying foil and means to raise and lower the movable support.

15. A hot stamping machine in accordance with claim 14 wherein the prime mover is an electric motor coupled via a clutch to a generally circular cam having a reduced diameter and cusp shape provided in its circumference, the movable support being coupled to a cam follower.

* * * * *